US009640909B2

(12) United States Patent
Chitaka et al.

(10) Patent No.: US 9,640,909 B2
(45) Date of Patent: May 2, 2017

(54) CONNECTOR DEVICE

(71) Applicant: DENSO CORPORATION, Kariya, Aichi-pref. (JP)

(72) Inventors: Hiroki Chitaka, Kariya (JP); Masaru Yokota, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 0 days.

(21) Appl. No.: 15/023,796

(22) PCT Filed: Sep. 23, 2014

(86) PCT No.: PCT/JP2014/004860
§ 371 (c)(1),
(2) Date: Mar. 22, 2016

(87) PCT Pub. No.: WO2015/045361
PCT Pub. Date: Apr. 2, 2015

(65) Prior Publication Data

US 2016/0233614 A1 Aug. 11, 2016

(30) Foreign Application Priority Data

Sep. 24, 2013 (JP) ..... 2013-197296

(51) Int. Cl.
*H01R 13/633* (2006.01)
*H01R 13/639* (2006.01)
*H01R 13/627* (2006.01)

(52) U.S. Cl.
CPC ..... *H01R 13/6335* (2013.01); *H01R 13/6272* (2013.01); *H01R 13/633* (2013.01); *H01R 13/639* (2013.01)

(58) Field of Classification Search
USPC ..... 439/352, 348, 345, 372, 159
See application file for complete search history.

(56) References Cited

FOREIGN PATENT DOCUMENTS

| | | | |
|---|---|---|---|
| JP | 3997483 | B2 | 10/2007 |
| JP | 2011000913 | A | 1/2011 |
| JP | 2011049074 | A | 3/2011 |

OTHER PUBLICATIONS

International Search Report and Written Opinion (in Japanese with English Translation) for PCT/JP2014/004860, mailed Nov. 18, 2014; ISA/JP.

*Primary Examiner* — Alexander Gilman
(74) *Attorney, Agent, or Firm* — Harness, Dickey & Pierce, P.L.C.

(57) ABSTRACT

In a connector device, a side surface of a protruding part on a base portion side of an opposite part is configured as an inclined surface that comes closer to an opposite surface in a direction toward the base portion side of the opposite part, and is engaged with an inclined surface of a second connector in a state where a first connector and the second connector are fitted together. The connector device includes a disengaging member that has a disengaging part arranged between the opposite part of the first connector and the second connector and including an end surface opposed to a side surface of the protruding part on an end side of the opposite part, and an operating part configured integrally with the disengaging part and protruding toward an opposite side of the disengaging part from the second connector. When the end surface is displaced in a direction to make contact with the protruding part, the end surface presses the protruding part. At least one of the side surface of the protruding part on the end side of the opposite part, and the end surface of the disengaging part of the disengaging member opposed to the side surface is configured as an inclined surface that comes closer to an end of the opposite part in a direction toward the opposite surface.

4 Claims, 5 Drawing Sheets

CONNECTOR DEVICE

CROSS REFERENCE TO RELATED APPLICATIONS

This application is a U.S. National Phase Application under 35 U.S.C. 371 of International Application No. PCT/JP2014/004860 filed on Sep. 23, 2014 and published in Japanese as WO 2015/045361 A1 on Apr. 2, 2015. This application is based on and claims the benefit of priority from Japanese Patent Application No. 2013-197296 filed on Sep. 24, 2013. The entire disclosures of all of the above applications are incorporated herein by reference.

TECHNICAL FIELD

The present disclosure relates to a connector device for electrically connecting one electric part to another electric part, and in particular, to a technique for unlocking connectors.

BACKGROUND ART

There has been known a pair of connectors for electrically connecting one electric part to other electric part. Here, the electric part described in the present specification designates a part that is electrically operated and includes also a part called an electronic part.

In Patent Document 1, an electronic device and a battery pack are electrically connected to each other by a pair of connectors which are fixed to the electronic device and the battery pack, respectively. The battery pack needs to be replaced, so that the pair of connectors need to be constructed in such a way as to be capable of being separated from each other.

PRIOR ART DOCUMENT

Patent Document

Patent Document 1: JP 2011-913A

A pair of connectors constructed in such a way as to be capable of being separated from each other have a locking structure so as to keep one connector from being taken out of the other connector in a normal operation. The locking structure is a structure in which: one connector has a protruding part formed thereon; and the other connector has an engaging surface which engages with the protruding part.

As the locking structure are known a strong locking structure and a friction locking structure. The strong locking structure is a structure in which a side surface of a protruding part and an engaging surface, which engage with each other when one connector is pulled out from the other connector, are vertical (or nearly vertical) to a direction in which one connector is pulled out from the other connector. On the other hand, the friction locking structure is a structure in which a side surface of a protruding part and an engaging surface, which engage with each other when one connector is pulled out from the other connector, are formed in inclined surfaces which are inclined to a direction in which one connector is pulled out from the other connector.

In the strong locking structure, a locking release lever integrated with the protruding part is provided near the protruding part, and when the locking release lever is pushed down, the protruding part is disengaged from the engaging surface. Then, when the connector having the protruding part formed thereon is pulled out in this state, the pair of connectors can be separated from each other.

In contrast to this, in the friction locking structure, the locking release lever is not provided, and when the inclined surface formed on the protruding part is moved along the engaging surface which is the inclined surface of the other connector, the protruding part and the engaging surface are disengaged from each other. The friction locking structure does not need the locking release lever and hence is less limited in an arrangement space than the strong locking structure. For this reason, in a case where there is a limitation in an arrangement space, for example, in a case where a small connector is received in a narrow place, a connector of a friction locking structure is employed in many cases.

However, even the friction locking structure has a locking strength to keep a pair of connectors from being separated from each other in a normal operation. For example, a friction locking connector used for an automobile or the like has a strong holding force to keep one connector from being taken out of the other connector by an external force such as vehicle vibrations. For this reason, only by pulling out the one connector from the other connector in a direction in which the pair of connectors are separated from each other, it is difficult to separate the pair of connectors from each other and a worker needs to lift up a part having a protruding part of the connector.

In this case, when the pair of connectors are separated from each other, for example, the part having the protruding part is pulled out with a portion having the protruding part lifted up by the use of a precise screwdriver or the like, which hence reduces the workability of an operation of separating a connector.

SUMMARY OF INVENTION

The present disclosure addresses the above issues. Thus, it is an objective of the present disclosure to provide a connector device in which connectors can be easily separated from each other.

To achieve the objective of the present disclosure, a connector device in an aspect of the present disclosure includes a first connector, a second connector, a disengaging member, and a holding member. The first connector is attached to a first electric part. The second connector is attached to a second electric part and is fitted to the first connector. The first connector includes a fitting part, an opposite part, and a protruding part. The fitting part is fitted to the second connector. The opposite part is opposed to the second connector away from the second connector in a state where the first connector and the second connector are fitted together. The protruding part protrudes from an opposite surface of the opposite part, which is opposed to the second connector, and includes a side surface on a base portion side of the opposite part and a side surface on an end side of the opposite part. The second connector includes an inclined surface that is provided on a surface of the second connector opposed to the opposite part of the first connector. The inclined surface comes closer to the opposite part of the first connector in a direction toward an end side of the second connector in the state where the first connector and the second connector are fitted together. The side surface of the protruding part on the base portion side of the opposite part is configured as an inclined surface that comes closer to the opposite surface in a direction toward the base portion side of the opposite part, and is engaged with the inclined surface of the second connector in the state where the first connector and the second connector are fitted together. The disengaging member includes a disengaging part and an operating part. The disengaging part is arranged between the opposite part of the first connector and the second connector and includes an end surface opposed to the side surface of the protruding part on the end side of the opposite part. The operating part is configured integrally with the disengaging part and protrudes toward an opposite side of the disengaging part from the second connector. When the end surface is displaced in a direction to make contact with the protruding part, the end surface presses the protruding part. The holding member is fixed to the second electric part and holds the disengaging member in such a way that the disengaging member is movable in a direction in which the first connector and the second connector are fitted together or separated from each other. At least one of the side surface of the protruding part on the end side of the opposite part, and the end surface of the disengaging part of the disengaging member opposed to the side surface is configured as an inclined surface that comes closer to an end of the opposite part in a direction toward the opposite surface.

According to this aspect of the present disclosure, when the operating part of the disengaging member is operated, the disengaging part of the disengaging member is moved toward the protruding part. Then, the end surface of the disengaging part pushes the side surface on the end side of the opposite part of the protruding part. At least one of the side surface on the end side of the opposite part of the protruding part and the end surface of the disengaging part of the disengaging member opposite to the side surface is formed in the inclined surface that comes closer to the end of the opposite part as a position is closer to the opposite surface side. For this reason, when the end surface of the disengaging part pushes the side surface on the end side of the opposite part of the protruding part, the protruding part is moved in a direction in which the side surface on the base portion side of the opposite part of the protruding part is separated from the inclined surface of the second connector. Hence, when the operating part is operated, the protruding part of the first connector can be disengaged from the inclined surface of the second connector.

The operating part is protruded to a side opposite to the second connector with respect to the disengaging part, so that a worker can easily operate the operating part. When the worker operates the operating part, the worker can disengage the protruding part of the first connector from the inclined surface of the second connector and hence can easily pull out the first connector from the second connector. In other words, the worker can easily perform an operation of separating a pair of connectors from each other.

BRIEF DESCRIPTION OF DRAWINGS

The above and other objects, features, and advantages of the present disclosure will become more apparent from the following detailed description made with reference to the accompanying drawings. In the drawings.

EMBODIMENT FOR CARRYING OUT INVENTION

Figure 1:
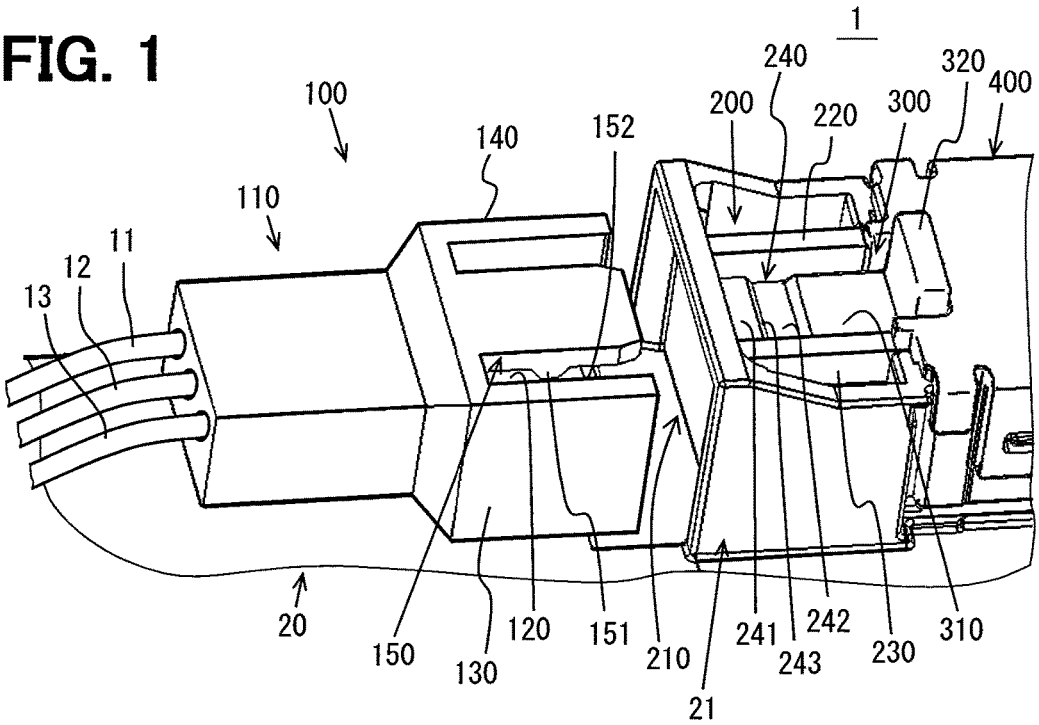
FIG. 1 is a perspective view of a connector device of an embodiment.
Figure 2:
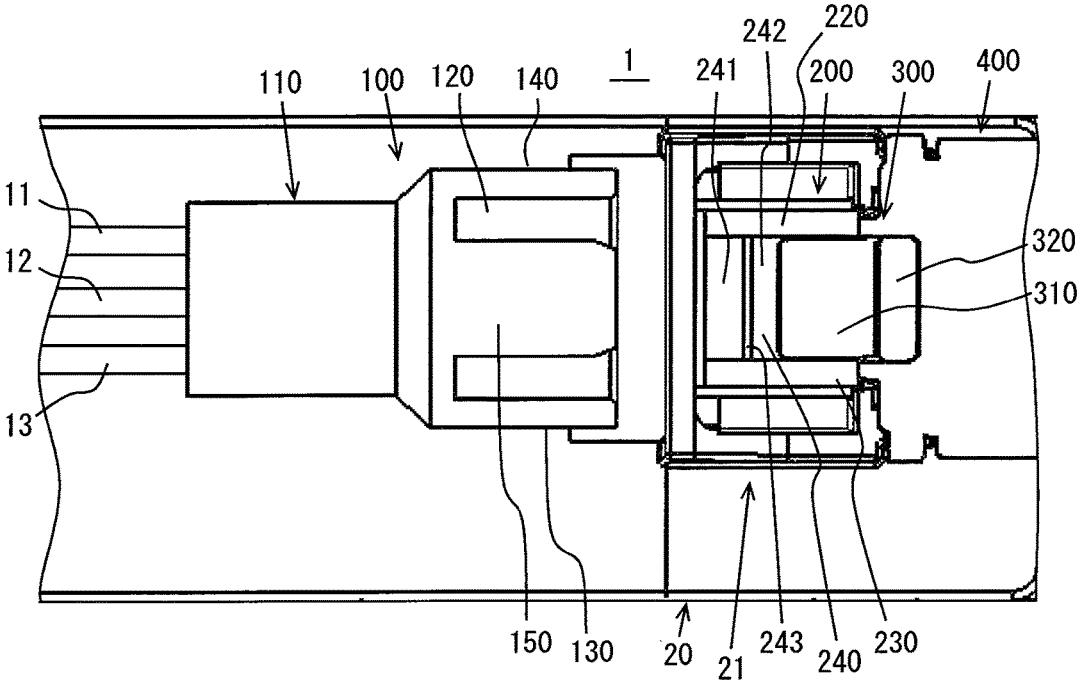
FIG. 2 is a top view of the connector device of the embodiment.

Hereinafter, an embodiment will be described on the basis of the drawings. FIGS. 1, 2 show a state in which a first connector 100 and a second connector 200 of a connector device 1 of the embodiment are not yet fitted in each other. FIG. 1 a perspective view and FIG. 2 is a top view.

The connector device 1 is provided with not only the first connector 100 and the second connector 200 but also a disengaging member 300 and a holding member 400.

A construction of the first connector 100 will be described. The first connector 100 has relay wires 11, 12, 13 connected thereto. These relay wires 11, 12, 13 correspond to a first electric part. The first connector 100 is electrically connected to an electric part, which is not shown in the drawing, by the relay wires 11, 12, 13.

The first connector 100 is provided with a base part 110, a fitting part 120, a pair of side guide parts 130, 140, and a locking part 150. Further, the first connector 100 is provided with also a bottom guide part 160.

The base part 110 has the relay wires 11, 12, 13 connected thereto. In the base part 110, an end on a side opposite to a side in which the relay wires 11, 12, 13 are connected is enlarged in diameter as compared with an end on the side in which the relay wires 11, 12, 13 are connected. To the end portion enlarged in diameter is coupled an end part of the pair of side guide parts 130, 140, the locking part 150, and the bottom guide part 160.

The fitting part 120 is formed in the shape of a rectangular solid and is coupled to the base part 110. The fitting part 120 is fitted in a fitted part 210 of the second connector 200.

The pair of side guide parts 130, 140 are arranged in parallel to a side surface of the fitting part 120 with a space to the fitting part 120 and is formed in the shape of a rectangular plate.

The bottom guide part 160 is arranged in parallel to a bottom surface of the fitting part 120 with a space to the fitting part 120 and is formed in the shape of a rectangular plate. The side guide parts 130, 140 and the bottom guide part 160 restrict a moving direction of the fitting part 120 when the first connector 100 is fitted in the second connector 200.

Figure 5:
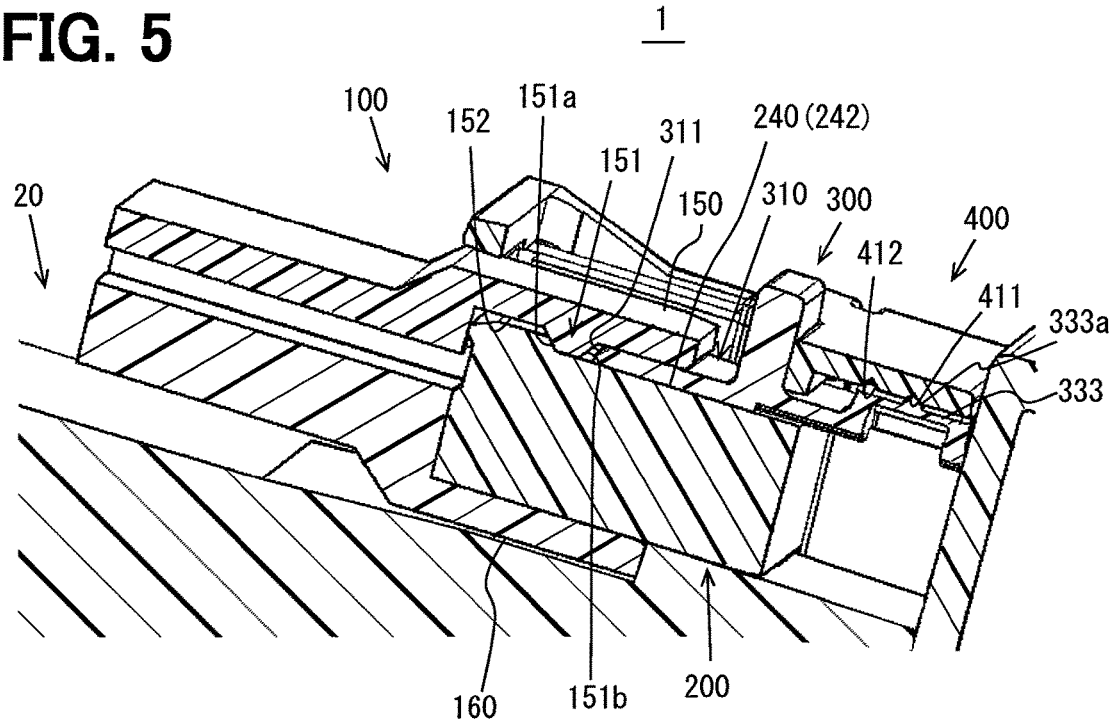
FIG. 5 is a section view taken on a line V-V of FIG. 4.

The locking part 150 corresponds to an opposite part claimed in the claims and is arranged in parallel to a top surface of the fitting part 120 with a space to the fitting part 120 and is formed in the shape of a rectangular plate. In a state in which the first connector 100 is fitted in the second connector 200, as shown in FIG. 5, the locking part 150 is separated from a top surface 240 of the second connector 200 and is opposed in parallel to the top surface 240.

A protruding part 151 is formed in a central portion in a moving direction of the first connector 100 of a bottom surface 152 (corresponding to an opposite surface claimed in the claims) of the locking part 150. The protruding part 151 is formed in a shape extending in a width direction of the locking part 150, or in a direction orthogonal to the moving direction of the first connector 100 and has the same length as a length in the width direction of the locking part 150.

Figure 3:
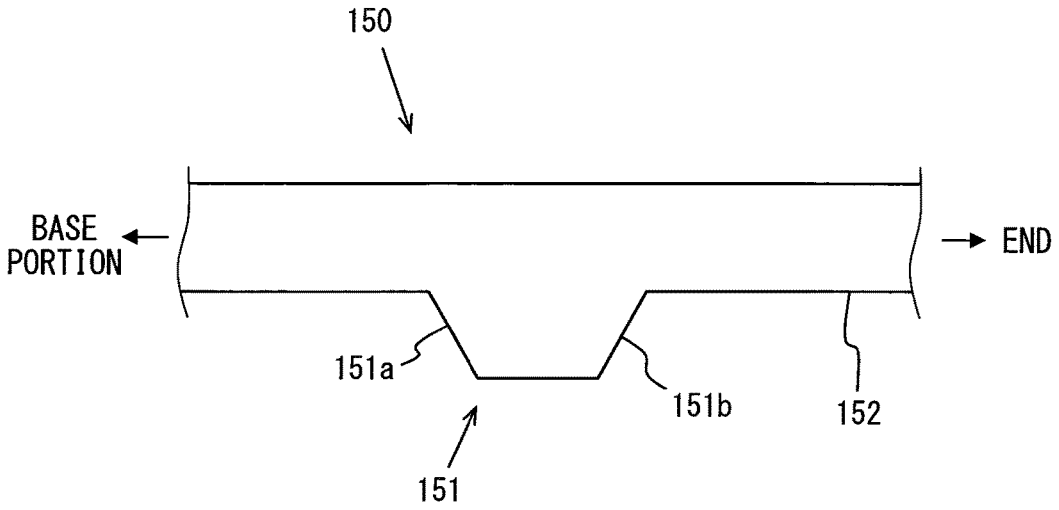
FIG. 3 is a partially enlarged view of a locking part in the embodiment.

Further, in the protruding part 151, as shown in an enlarged view of FIG. 3, both of a side surface 151*a* on a base portion side of the locking part 150 and a side surface 151*b* on an end side of the locking part 150 are formed in inclined surfaces. In more detail, the side surface 151*a* is the inclined surface which comes closer to the base portion of the locking part 150 as a portion comes closer to the bottom surface 152 (that is, closer to a top side of FIG. 3). The other side surface 151*b* is the inclined surface which comes closer to an end of the locking part 150 as a portion comes closer to the bottom surface 152 (that is, closer to the top side of FIG. 3).

A construction of the second connector 200 will be described. The second connector 200 is fixed to a unit 20 in which a plurality of electric parts are integrated.

This unit 20 corresponds to a second electric part. The unit 20 has a connector holding part 21 formed therein, and the second connector 200 is fixed to the connector holding part 21.

The second connector 200 is provided with a fitted part 210 and a pair of beam parts 220, 230. The fitted part 210 is formed in the shape of a rectangular solid and has the fitting part 120 of the first connector 100 fitted therein.

The pair of beam parts 220, 230 are formed in parallel to each other on both ends in a width direction of the top surface 240 of the fitted part 210 (that is, surface on a side opposite to a surface on a unit 20 side). A distance between the pair of beam parts 220, 230 is longer than a length in a width direction of the locking part 150 of the first connector 100.

Further, a distance between the pair of side guide parts 130, 140 of the first connector 100 is a little longer than a length in a width direction of the second connector 200. Still further, a distance between the locking part 150 and a bottom guide part 160 is a little longer than a distance between a top surface and a bottom surface of the second connector 200. Thus, when the first connector 100 is inserted into the second connector 200, a position of the fitting part 120 of the first connector 100 is held in a position in which the fitting part 120 of the first connector 100 can be fitted in the fitted part 210 of the second connector 200 by the side guide parts 130, 140, the locking part 150, and the bottom guide part 160.

The top surface 240 of the second connector 200 has an end surface 241, a main top surface 242, and an inclined surface 243. The end surface 241 is a rectangular plane which constructs an end side of the second connector 200 of the top surface 240. The main top surface 242 is a rectangular plane which constructs a surface closer to a base portion side of the second connector 200 than the inclined surface 243 of the top surface 240 and which is lower in height than the end surface 241.

The inclined surface 243 is a slender rectangular plane to couple the end surface 241 to the main top surface 242. In a state in which the first connector 100 is fitted in the second connector 200, the locking part 150 of the first connector 100 is positioned above the inclined surface 243. Thus, in the state in which the first connector 100 is fitted in the second connector 200, the inclined surface 243 comes closer to the locking part 150 of the first connector 100 as a position is closer to an end side of the second connector 200.

Figure 4:
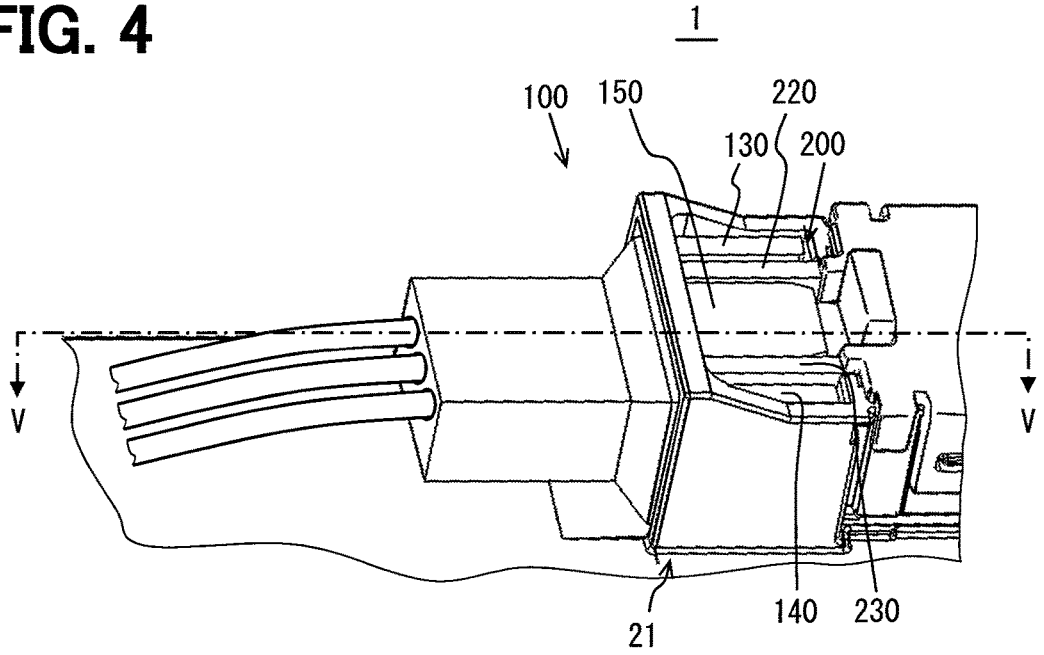
FIG. 4 is a perspective view of the connector device in a state in which a first connector is fitted in a second connector in the embodiment.

A fitting state will be described. As shown in FIG. 4, in the state in which the first connector 100 is fitted in the second connector 200, the locking part 150 of the first connector 100 is positioned between the pair of beam parts 220, 230 of the second connector 200. Further, the pair of side guide parts 130, 140 of the first connector 100 are positioned between the connector holding part 21 and the second connector 200, respectively.

A construction of the disengaging member 300 will be described. The disengaging member 300 is provided with a disengaging part 310 and an operating part 320 which are shown in FIGS. 1, 2. The disengaging part 310 is formed in the shape of a plate arranged on the top surface 240 of the second connector 200. The operating part 320 is formed integrally with the disengaging part 310 and is protruded in a vertical direction of the disengaging part 310 from the disengaging part 310, and a top end of the operating part 320 is higher than a top surface of the holding member 400.

Figure 6:
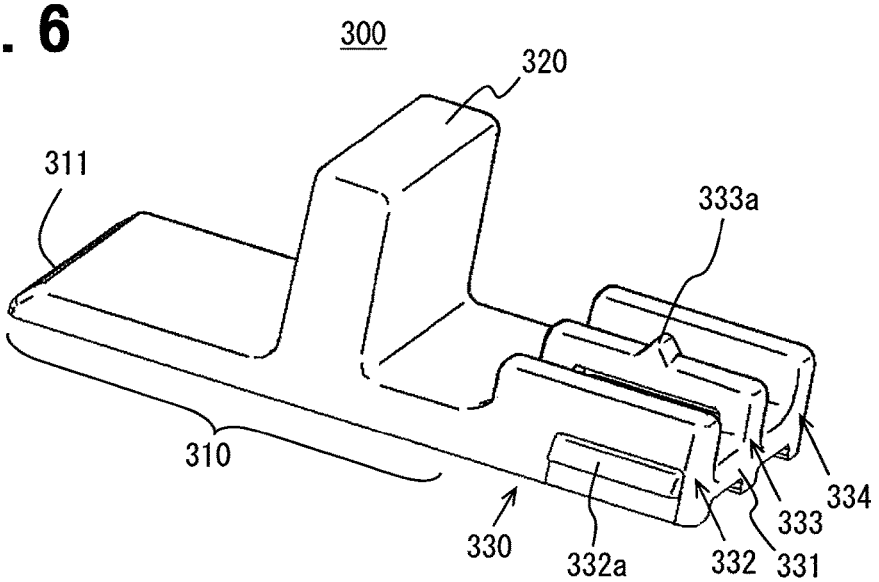
FIG. 6 is a perspective view of a disengaging member in the embodiment.

The disengaging member 300 will be described in detail by the use of FIG. 6. The disengaging part 310 is formed in the shape of a rectangular plate and has an end surface 311 thereof formed in an inclined surface. An inclination of the end surface 311 has almost the same angle as an inclination of the side surface 151*b* on the end side of the locking part 150 and is more inclined to a base portion side of the disengaging member 300 as a position is closer to a top side (side in which the operating part 320 is protruded). Further, the disengaging part 310 has a motion restricting part 330 coupled to a base end thereof.

The operating part 320 is also formed in the shape of a rectangular plate and is protruded vertically from the disengaging part 310 in the same width as a width of the disengaging part 310 at a position closer to the base end than the center in a longitudinal direction of the disengaging part 310.

The motion restricting part 330 restricts the position of the disengaging member 300 in a direction in which the first connector 100 is inserted in or pulled out and a direction intersecting the direction in which the first connector 100 is inserted in or pulled out.

The motion restricting part 330 has a construction in which three protruding narrow parts 332, 333, 334 are protruded from a base plate part 331. These three protruding narrow parts 332, 333, 334 are parallel to each other and are equal to each other in length and width.

The protruding narrow part 332 is arranged on the base plate part 331 along an end in a longitudinal direction of the disengaging part 310. Further, the protruding narrow part 334 is arranged at an end on a side, which is opposite to a side in which the protruding narrow part 332 is arranged, of the base plate part 331 along an end in the longitudinal direction of the disengaging part 310. The protruding narrow part 333 is arranged on the base plate part 331 in the middle of these two protruding narrow parts 332, 334.

The protruding narrow part 332 has a rail part 332*a* formed on a side surface of the outside, that is, the side surface of the outside in a direction in which the protruding narrow parts 332, 333, 334 are arranged. Further, the protruding narrow part 334 arranged on the base plate part 331 at an end on a side opposite to the protruding narrow part 332 also has a rail part 334*a* (see FIG. 8) formed on a side surface of the outside. These rail parts 332*a*, 334*a* correspond to disengaging part side guides claimed in the claim. These rail parts 332*a*, 334*a* are formed in parallel to the disengaging part 310.

Further, in the central protruding narrow part 333, a fitting protrusion 333*a* to protrude up (that is, in a direction opposite to the base plate part 331) is formed in the center in a longitudinal direction thereof. The fitting protrusion 333*a* is formed in the shape of an isosceles triangle when the protruding narrow part 333 is viewed from the side.

Figure 7:
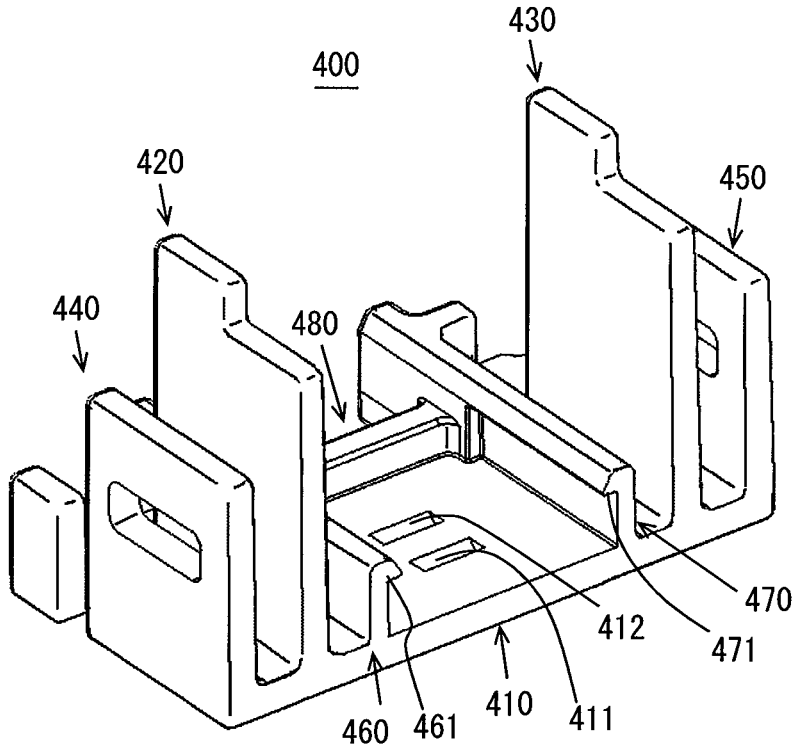
FIG. 7 is a perspective view of a holding member in the embodiment.

A construction of the holding member 400 will be described. The holding member 400 is fixed to the unit 20. A shape of the holding member 400 will be described in detail by the use of FIG. 7. The holding member 400 is provided with a base plate part 410, a pair of large fixing parts 420, 430, a pair of small fixing parts 440, 450, a pair of guide parts 460, 470, and a receiving plate part 480.

The base plate part 410 is formed in the shape of a rectangular plate, and a longitudinal direction of the base plate part 410 is a width direction of the first connector 100 and the second connector 200. The pair of large fixing parts 420, 430, the pair of small fixing parts 440, 450, the pair of guide parts 460, 470, and the receiving plate part 480 are protruded vertically from the base plate part 410 with respect to the base plate part 410.

The pair of large fixing parts 420, 430 are engaged with a fixing structure, which is not shown in the drawing, of the unit 20. The pair of small fixing parts 440, 450 are smaller in size than the pair of large fixing parts 440, 450 and are positioned outside in the longitudinal direction of the base plate part 410. The pair of small fixing parts 440, 450 are also engaged with a fixing structure, which is not shown in the drawing, of the unit 20.

The pair of guide parts 460, 470 are arranged between the pair of large fixing parts 420, 430. The pair of guide parts 460, 470 are formed in a narrow shape, respectively, and are arranged in parallel to each other. Further, a distance between the pair of guide parts 460, 470 is a slightly longer than a distance between outside surfaces of the pair of protruding narrow parts 332, 334 formed in the disengaging member 300.

The guide part 460 has a rail part 461 formed on the inside thereof, that is, on a side opposite to the other guide part 470 entirely along the longitudinal direction of the guide part 460. Similarly, the guide part 470 has a rail part 471 formed on the inside thereof, that is, on a side opposite to the other guide part 460 entirely along the longitudinal direction of the guide part 470. These rail parts 461, 471 correspond to a holding part side guide claimed in the claim.

The rail parts 461, 471 are formed along a direction in which the first connector 100 is fitted in and separated from the second connector 200, respectively. The rail parts 332*a*, 334*a* formed on the protruding narrow parts 332, 334 of the disengaging member 300 described above engage with these rail parts 461, 471, respectively. Thus, the rail parts 332*a*, 334*a* are also formed along the direction in which the first connector 100 is fitted in and separated from the second connector 200, respectively.

The receiving plate part 480 is formed between the guide parts 460, 470 in one side in the longitudinal direction of the base plate part 410. The receiving plate part 480 is opposed to the operating part 320 of the disengaging member 300.

The base plate part 410 has two fitted depressed parts, that is, a first fitted depressed part 411 and a second fitted depressed part 412 formed in the center in the longitudinal direction of a surface opposite to the disengaging member 300. A direction in which these two fitted depressed parts 411, 412 are arranged is a direction in which the disengaging member 300 is moved relatively to the holding member 400. Further, in both of the two fitted depressed parts 411, 412, a section in a width direction of the base plate part 410 is formed in the shape of an isosceles triangle and is formed in a size in which the fitting protrusion 333*a* formed on the disengaging member 300 is fitted. A distance between the fitted depressed parts 411, 412 is longer than a distance between the end surface 311 of the disengaging part 310 and the side surface 151*b* of the protruding part 151 of the locking part 150 in a state in which the fitting protrusion 333*a* of the disengaging member 300 is fitted in the first fitted depressed part 411.

Figure 8:
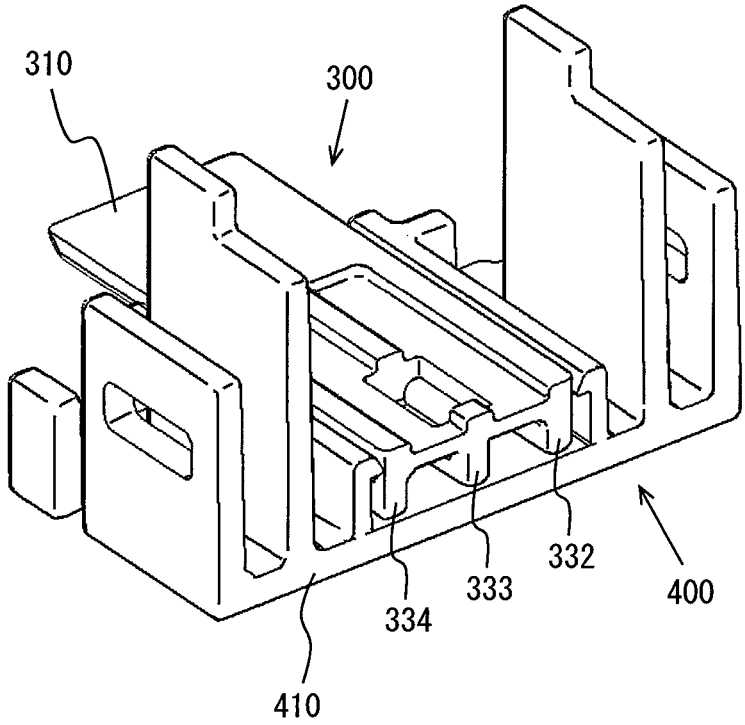
FIG. 8 is a perspective view to show a state in which the disengaging member is combined with the holding member in the embodiment.
Figure 9:
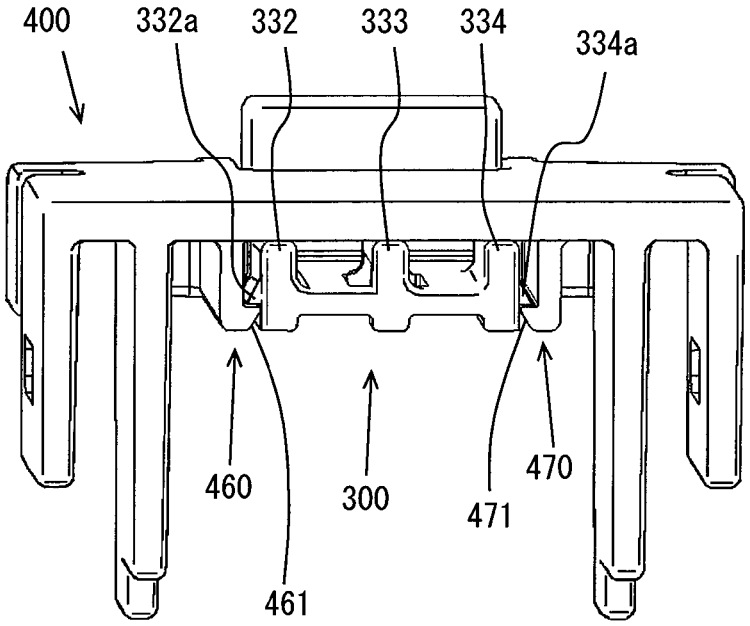
FIG. 9 is a front view to show a state in which the disengaging member is combined with the holding member in the embodiment.

FIGS. 8, 9 show a state in which the disengaging member 300 is combined with the holding member 400. As shown in FIG. 8, the disengaging member 300 is combined with the holding member 400 in such a way that the protruding narrow parts 332, 333, 334 of the disengaging member 300 are closer to a side of the base plate part 410 of the holding member 400 and that the disengaging part 310 is protruded in a width direction of the base plate part 410 from the holding member 400.

Further, as shown in FIG. 9, the rail parts 332*a*, 334*a* formed on the protruding narrow parts 332, 334 of the disengaging member 300 engage with the rail parts 461, 471 formed on the guide parts 460, 470 of the holding member 400. In this way, in a state in which the disengaging member 300 is combined with the holding member 400, the disengaging member 300 can be moved relatively in the longitudinal direction of the disengaging member 300 with respect to the holding member 400.

However, in the state in which the disengaging member 300 is combined with the holding member 400, the first fitted depressed part 411 and the second fitted depressed part 412 are on a straight line in which the fitting protrusion 333*a* is moved. For this reason, the disengaging member 300 can hold a position relative to the holding member 400 at two positions of a position in which the fitting protrusion 333*a* is fitted in the first fitted depressed part 411 and a position in which the fitting protrusion 333*a* is fitted in the second fitted depressed part 412.

FIG. 5 shows the position in which the fitting protrusion 333*a* is fitted in the first fitted depressed part 411 of the two positions of the disengaging member 300. As shown in FIG. 5, in a state in which the fitting protrusion 333*a* is fitted in the first fitted depressed part 411, the disengaging member 300 is positioned at a position in which the disengaging part 310 is not in contact with the protruding part 151 of the first connector 100.

An action of separating the connectors 100, 200 will be described. An action when the first connector 100 is separated from the second connector 200 in the connector device 1 of the present embodiment will be described by the use of FIG. 5.

As shown in FIG. 5, in a state in which the first connector 100 is fitted in the second connector 200, the side surface 151*a* of the locking part 150 engages with the inclined surface 243 of the top surface 240 of the second connector 200. In this way, the first connector 100 is kept from being taken off from the second connector 200 in a normal time.

Further, in the state in which the first connector 100 is fitted in the second connector 200, the disengaging part 310 of the disengaging member 300 is positioned between the locking part 150 of the first connector 100 and the top surface 240 of the second connector 200.

Further, an end of the operating part 320 of the disengaging member 300 is protruded further than the top surface of the holding member 400. For this reason, a worker can operate the end of the operating part 320 by a hand to easily move the disengaging member 300 in a direction in which the end surface 311 of the disengaging part 310 is moved toward the protruding part 151 formed on the locking part 150.

When the end surface 311 of the disengaging part 310 is moved toward the protruding part 151 formed on the locking part 150, the end surface 311 of the disengaging part 310 abuts on the side surface 151*b* of the protruding part 151.

The end surface 311 of the disengaging part 310 and the side surface 151*b* of the protruding part 151 are inclined in the same direction. For this reason, when the disengaging member 300 is moved in the same direction as before also after the end surface 311 of the disengaging part 310 abuts on the side surface 151*b* of the protruding part 151, the protruding part 151 is moved upward, that is, in a direction to separate from the main top surface 242 of the second connector 200. Further, the locking part 150 is brought into a bent shape by the motion of the protruding part 151.

Further, when the worker operates the operating part 320 to move the disengaging member 300 in a direction of the first connector 100, the fitting protrusion 333*a* formed on the protruding narrow part 333 of the disengaging member 300 is fitted in the second fitted depressed part 412 which is the fitted depressed part formed on the first connector 100 side. For this reason, the disengaging member 300 is held at that position.

In a state in which the fitting protrusion 333*a* is fitted in the second fitted depressed part 412, the end surface 311 of the disengaging part 310 moves up the protruding part 151 of the locking part 150. In other words, there is brought about a state in which the side surface 151*a* of the protruding part 151 is disengaged from the inclined surface 243 of the top surface 240 of the second connector 200.

Hence, when the worker pulls out the first connector 100 in this state, the worker can easily separate the first connector 100 from the second connector 200.

Advantages of the present embodiment will be described. According to the present embodiment described above, when the worker operates the operating part 320 of the disengaging member 300, the disengaging part 310 of the disengaging member 300 is moved in the direction of the protruding part 151. Then, the end surface 311 of the disengaging part 310 pushes the side surface 151*b* on the end side of the locking part of the protruding part 151. The side surface 151*b* on the end side of the locking part of the protruding part 151 is formed in an inclined surface which comes closer to the bottom surface 152 of the locking part 150 as a position is closer to the end side of the locking part 150. For this reason, when the end surface 311 of the disengaging part 310 pushes the side surface 151*b* on the end side of the locking part of the protruding part 151, the protruding part 151 is moved in a direction in which the side surface 151*a* on the base portion side of the locking part of the protruding part 151 is separated from the inclined surface 243 of the second connector 200. Hence, when the worker operates the operating part 320, the worker can disengage the protruding part 151 of the first connector 100 from the inclined surface 243 of the second connector 200.

The operating part 320 is protruded to an upper side (a side opposite to the second connector 200) with respect to the disengaging part 320, so that the worker can easily operate the operating part 320. When the worker operates the operating part 320, the worker can disengage the protruding part 151 of the first connector 100 from the inclined surface 243 of the second connector 200 and hence can easily pull out the first connector 100 from the second connector 200. In other words, the worker can easily perform an operation of separating the pair of connectors 100, 200 from each other.

Further, in the present embodiment, the disengaging member 300 has the rail parts 332*a*, 334*a* formed along the direction in which the first connector 100 is fitted in and separated from the second connector 200. Further, the holding member 400 has the rail parts 461, 471 formed along the direction in which the first connector 100 is fitted in and separated from the second connector 200. In this way, the disengaging member 300 can be moved relatively in the direction in which the first connector 100 is fitted in and separated from the second connector 200 but is restrained from moving relatively in the width direction of the connectors 100, 200.

Hence, by operating the operating part 320, the disengaging member 300 can be easily moved in a direction in which the end surface 311 of the disengaging part 310 abuts on the protruding part 151 of the first connector 100.

Further, in the present embodiment, the disengaging member 300 has the fitting protrusion 333*a* formed thereon and the holding member 400 has the first fitted depressed part 411 formed thereon, the first fitted depressed part 411 having the fitting protrusion 333*a* fitted therein. When the fitting protrusion 333*a* is fitted in the first fitted depressed part 411, the disengaging member 300 is positioned at a position in which the disengaging part 310 is not in contact with the protruding part 151 of the first connector 100. In this way, it is possible to restrain the disengaging member 300 from naturally moving to thereby disengage the protruding part 151 of the first connector 100 from the inclined surface 243 of the second connector 200 in a normal operation in which the first connector 100 is not pulled out of the second connector 200.

Further, in the present embodiment, the holding member 400 has also the second fitted depressed part 412 formed therein. In a state in which the second fitted depressed part 412 has the fitting protrusion 333*a* fitted therein, the position of the disengaging member 300 is held at a position in which an end of the disengaging part 310 of the disengaging member 300 pushes up the protruding part 151 of the first connector 100. Hence, when the first connector 100 is pulled out, the protruding part 151 of the first connector 100 is restrained from again engaging with the inclined surface 243 of the second connector 200, so that an operation of pulling out the first connector 100 can be made easier.

Up to this point, the present embodiment has been described. However, the present disclosure is not limited to the embodiment described above but the following modifications can be included in the technical scope of the present disclosure. Further, in addition to the following modifications, the present disclosure can be variously modified and carried out within a range not departing from the gist of the present disclosure.

A first modification will be described. For example, in the embodiment described above, the fitting protrusion 333*a* is formed on the disengaging member 300 and the fitted depressed parts 411, 412, which have the fitting protrusion 333*a* fitted therein, are formed on the holding member 400. However, in contrast to this, the disengaging member 300 may have the fitted depressed parts formed thereon and the holding member 400 may have the fitting protrusion formed thereon, the fitting protrusion engaging with the fitted depressed parts.

Second and third modifications will be described. In the embodiment described above, both of the end surface 311 of the disengaging part 310 and the side surface 151*b* of the protruding part 151 are formed in the inclined surfaces inclined in the same direction. However, the shapes of the end surface 311 and the side surface 151*b* are not limited to the inclined surfaces, but only the end surface 311 of the disengaging part 310 may be formed in an inclined surface and the side surface 151*b* of the protruding part 151 may be formed in a vertical surface which is not inclined with respect to the bottom surface 152 of the protruding part 151 (the second modification).

In contrast to this, only the side surface 151*b* of the protruding part 151 may be formed in an inclined surface and the end surface 311 of the disengaging part 310 may be formed in a vertical surface which is not inclined with respect to the bottom surface 152 of the protruding part 151 (the third modification).

While the present disclosure has been described with reference to embodiments thereof, it is to be understood that the present disclosure is not limited to the embodiments and constructions. The present disclosure is intended to cover various modifications and equivalent arrangements. In addition, while the various combinations and configurations, other combinations and configurations, including more, less or only a single element, are also within the spirit and scope of the present disclosure.

What is claimed is:

1. A connector device comprising:

a first connector that is attached to a first electric part;

a second connector that is attached to a second electric part and is fitted to the first connector, wherein:

the first connector includes:

a fitting part that is fitted to the second connector;

an opposite part that is opposed to the second connector away from the second connector in a state where the first connector and the second connector are fitted together; and a protruding part that protrudes from an opposite surface of the opposite part, which is opposed to the second connector, and that includes a side surface on a base portion side of the opposite part and a side surface on an end side of the opposite part;

the second connector includes an inclined surface that is provided on a surface of the second connector opposed to the opposite part of the first connector;

the inclined surface comes closer to the opposite part of the first connector in a direction toward an end side of the second connector in the state where the first connector and the second connector are fitted together; and the side surface of the protruding part on the base portion side of the opposite part is configured as an inclined surface that comes closer to the opposite surface in a direction toward the base portion side of the opposite part, and is engaged with the inclined surface of the second connector in the state where the first connector and the second connector are fitted together;

a disengaging member that includes:

a disengaging part that is arranged between the opposite part of the first connector and the second connector and includes an end surface opposed to the side surface of the protruding part on the end side of the opposite part; and an operating part that is configured integrally with the disengaging part and protrudes toward an opposite side of the disengaging part from the second connector, wherein when the end surface is displaced in a direction to make contact with the protruding part, the end surface presses the protruding part; and a holding member that is fixed to the second electric part and holds the disengaging member in such a way that the disengaging member is movable in a direction in which the first connector and the second connector are fitted together or separated from each other, wherein at least one of the side surface of the protruding part on the end side of the opposite part, and the end surface of the disengaging part of the disengaging member opposed to the side surface is configured as an inclined surface that comes closer to an end of the opposite part in a direction toward the opposite surface.

2. The connector device according to claim 1, wherein:

the disengaging member includes a disengaging part side guide that is formed along the direction in which the first connector and the second connector are fitted together or separated from each other; and the holding member includes a holding part side guide that is formed along the direction in which the first connector and the second connector are fitted together or separated from each other and that is engaged with the disengaging part side guide such that the disengaging member is movable relative to the holding member in the direction in which the first connector and the second connector are fitted together or separated from each other.

3. The connector device according to claim 1, further comprising:

a fitting protrusion that is formed on one of the disengaging member and the holding member; and a first fitted depressed part that is formed on the other one of the disengaging member and the holding member and is fitted to the fitting protrusion to position the disengaging member at a position where the disengaging part of the disengaging member is not in contact with the protruding part of the first connector.

4. The connector device according to claim 3, further comprising a second fitted depressed part that is formed on one of the disengaging member and the holding member on which the first fitted depressed part is formed, and that is fitted to the fitting protrusion to position the disengaging member at a position where an end of the disengaging part of the disengaging member pushes up the protruding part of the first connector.

* * * * *